US005251903A

United States Patent [19]

Bixler et al.

[11] Patent Number: 5,251,903

[45] Date of Patent: Oct. 12, 1993

[54] BALL WITH GRIP PRESSURE INDICATOR

[76] Inventors: Dickie R. Bixler; Matthew R. Bixler, both of Rte. 1, Box 33, Dacoma, Okla. 73731

[21] Appl. No.: 963,565

[22] Filed: Oct. 19, 1992

[51] Int. Cl.[5] ..... A63B 69/40

[52] U.S. Cl. ..... 273/26 R; 273/58 G; 273/60 R; 273/213

[58] Field of Search ..... 273/58 C, 58 R, 58 G-58 J, 273/213, 60 R

[56] References Cited

U.S. PATENT DOCUMENTS

| | | | |
|---|---|---|---|
| 3,031,194 | 4/1962 | Strayer | 273/213 |
| 3,868,692 | 2/1975 | Woodard | 273/213 |
| 4,303,853 | 12/1981 | Thalmann | 273/372 |
| 4,305,142 | 12/1981 | Springer | 273/372 |
| 4,775,948 | 10/1988 | Dial et al. | 273/58 G |
| 4,872,854 | 10/1989 | Hseu | 273/58 G |

FOREIGN PATENT DOCUMENTS

| | | | |
|---|---|---|---|
| 8902768 | 4/1989 | Fed. Rep. of Germany | 273/213 |

OTHER PUBLICATIONS

Popular Science, p. 30, Sep. 12, 1987.

Pot-Pour.ri, p. 93 Sep. 12, 1987.

*Primary Examiner*—Theatrice Brown

*Attorney, Agent, or Firm*—Head & Johnson

[57] ABSTRACT

The present invention is a pressure indicating ball for training baseball or softball pitchers. The ball contains a mass/weight control material to give the ball the proper heft. The ball has a perimeter envelope fillable by means of a valve located on a flexible exterior surface of the ball. The envelope is filled with a pressure indicating substance that allows an imprint of the pitcher's fingers to be created in the ball's flexible exterior surface. The ball is provided with a number of pressure transducers for sensing pressure exerted on the ball and translating pressure into electrical impulses. The electrical impulses are then transmitted to means for processing electrical impulses, such as a summation circuit, via a battery powered electrical circuit. The summation circuit is, in turn, electrically connected to a digital readout screen located on the ball's exterior surface where pressure data is displayed. Alternately or additionally, the summation circuit is electrically connected to a transmitter provided with an antenna that transmits the pressure data to a remote receiving device for display.

11 Claims, 2 Drawing Sheets

BALL WITH GRIP PRESSURE INDICATOR

BACKGROUND OF THE INVENTION

1. Field of the Invention

The present invention is a ball provided with pressure indicating features that allow a person throwing the ball to receive feedback regarding force exerted by him on the ball as he throws it.

2. The Prior Art

In the past, pitchers have been taught the fundamentals of leg, arm, body and eye position and control while pitching a ball, such as a baseball or a softball. However, a pitcher could execute all of these fundamentals of body movement correctly and still throw pitches that did not travel as desired, i.e. out-of-control pitches.

Research has shown that the amount of pressure exerted on the ball before release from the pitcher's hand has a great deal to do with where the ball travels after it is released. For example, when too much pressure is exerted on the ball before release, the pitcher tends to release the ball late with the result that the ball travels off-target, usually low and outside the strike zone located over home plate.

Also in the past, pitchers have had difficulty learning how to place their fingers on the ball in order to throw certain types of pitches, such as curve balls, sliders, and knuckle balls. Although outlines have been drawn on balls to indicate where the pitcher's fingers should be placed in order to throw various types of pitches, until now there has been no way of determining whether the pitcher's fingers were actually properly placed during execution of the pitch. With proper finger placement, proper grip pressure, and proper fundamentals of body movement, a pitcher has a much greater chance of throwing an on-target pitch.

The present invention offers reinforcement and feedback regarding the amount and location of pressure applied to the ball before release of the ball in order to assist the pitcher in finding and maintaining his best pressure grip for optimum ball control. To do this, the ball is provided with pressure sensing means for registering the amount and location of pressure exerted on the ball by the pitcher as he throws the ball and means for providing feedback to the pitcher regarding the pressure information registered by the sensing means.

SUMMARY OF THE INVENTION

The present invention is a pressure grip ball provided with a flexible exterior surface and provided interiorly with mass/weight control material to give the ball the proper heft. A perimeter envelope is located within the ball adjacent to the exterior surface. The envelope is filled via a valve, located on the exterior surface, with a pressure indicating substance that allows imprints of a pitcher's fingers to be created on the exterior surface of the ball. The ball is provided with a multiplicity of pressure transducers that produce electrical impulses that are proportional to the amount of pressure exerted on them. These electrical impulses are transmitted via an electrical circuit to a summation circuit where the electrical impulses are processed. The summation circuit has an electrical connection with a digital readout screen located on the exterior surface of the ball for displaying pressure data. Alternately or additionally, the summation circuit has an electrical connection with a transmitter that is provided with an antenna for transmitting pressure data to a remote receiving unit.

DETAILED DESCRIPTION OF THE PREFERRED EMBODIMENTS

Figure 1:
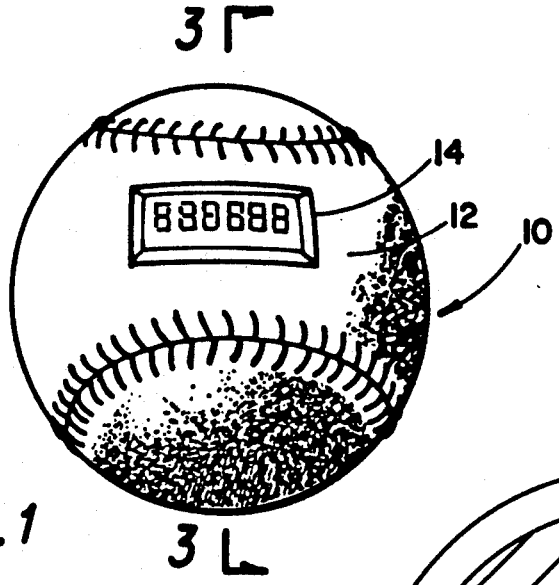
FIG. 1 is a perspective view of a pressure grip ball constructed according to a preferred embodiment of the present invention.

Referring now to the drawings and initially to FIG. 1, there is illustrated a pressure grip ball, generally designated by reference numeral 10, constructed according to a preferred embodiment of the present invention. The ball 10 is provided with a flexible exterior surface 12 that looks similar to a standard ball, either a baseball or a softball, but differs in that the exterior surface of ball 10 is provided with a digital readout screen 14 for displaying pressure applied to the ball 10 as will hereinafter be described.

Figure 2:
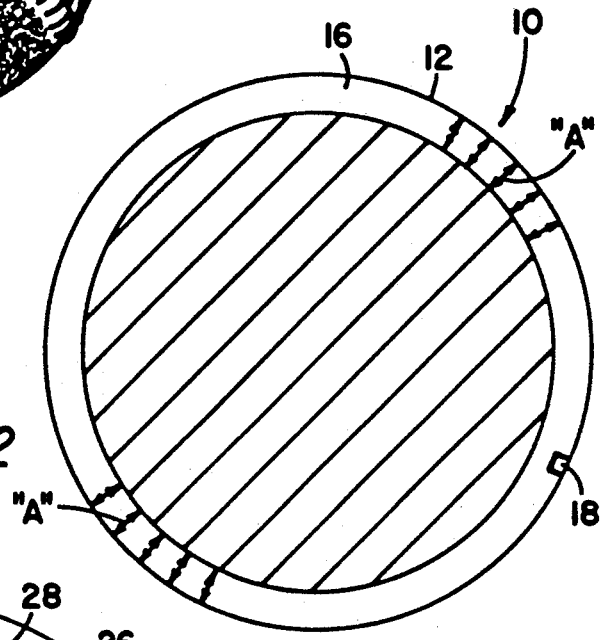
FIG. 2 is an enlarged partial cut away view of the pressure grip ball of FIG. 1 showing the front part of the exterior surface removed.

Now referring to FIG. 2 a partial cross-sectional view of the ball 10 reveals a perimeter envelope 16 located within the ball 10 just interior to the exterior surface 12. A valve 18 located on the exterior surface 12 and communicating between the exterior surface 12 and the envelope 16 provides access to the envelope 16 in order to fill or void the envelope 16. The envelope 16 is to be filled for use with a pressure indicating substance (not shown). The pressure indicating substance (not shown) may be "Silly Putty" ®, "Play-Doh" ®, clay or other similar material. As illustrated by the arrows "A" in FIG. 2 and FIG. 4, the pressure indicating substance will deform to create imprints 22 of the pitcher's fingers (not shown) in the flexible exterior surface 12. Imprints 22 provide the pitcher (not shown) with useful information regarding his finger placement on the ball 10 and give a direct visual indication of the pressure he is exerting on the ball 10.

Figure 3:
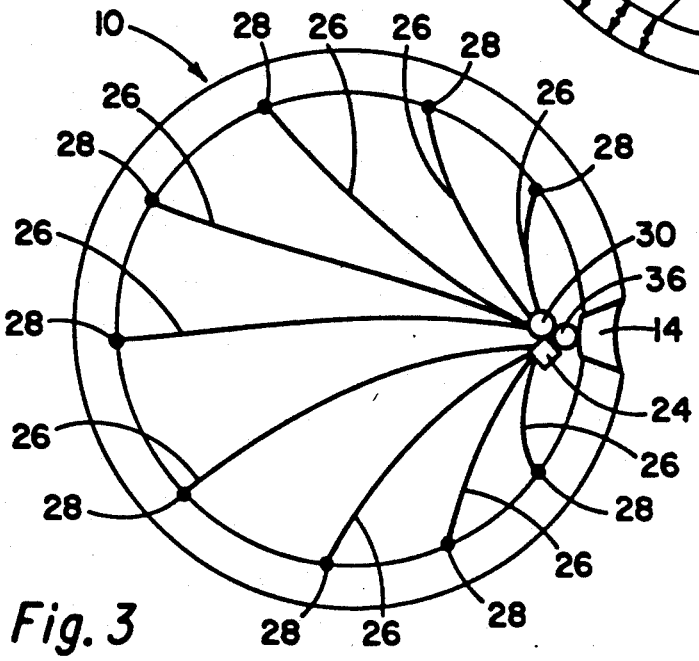
FIG. 3 is a cross-sectional view taken along line 3—3 of FIG. 1.
Figure 4:
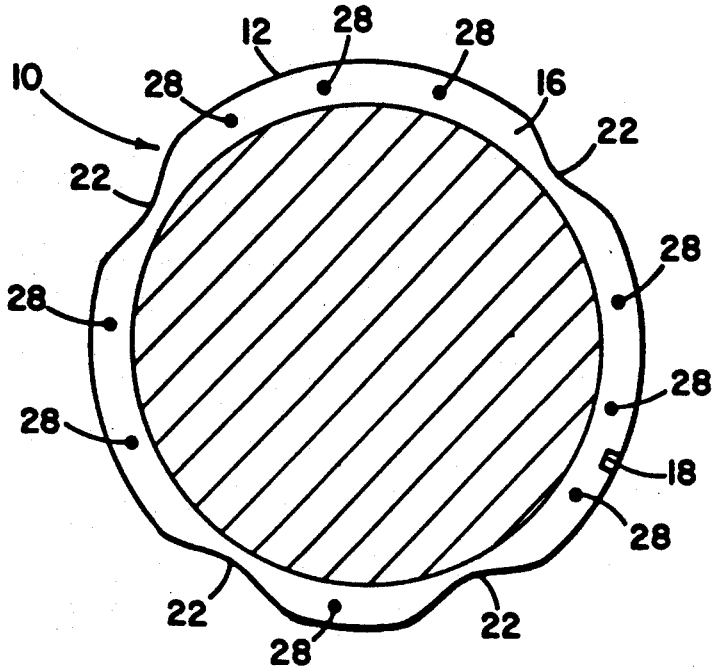
FIG. 4 is a view similar to FIG. 2 illustrating how imprints are formed in the exterior surface by a pitcher's fingers gripping the ball.
Figure 5:
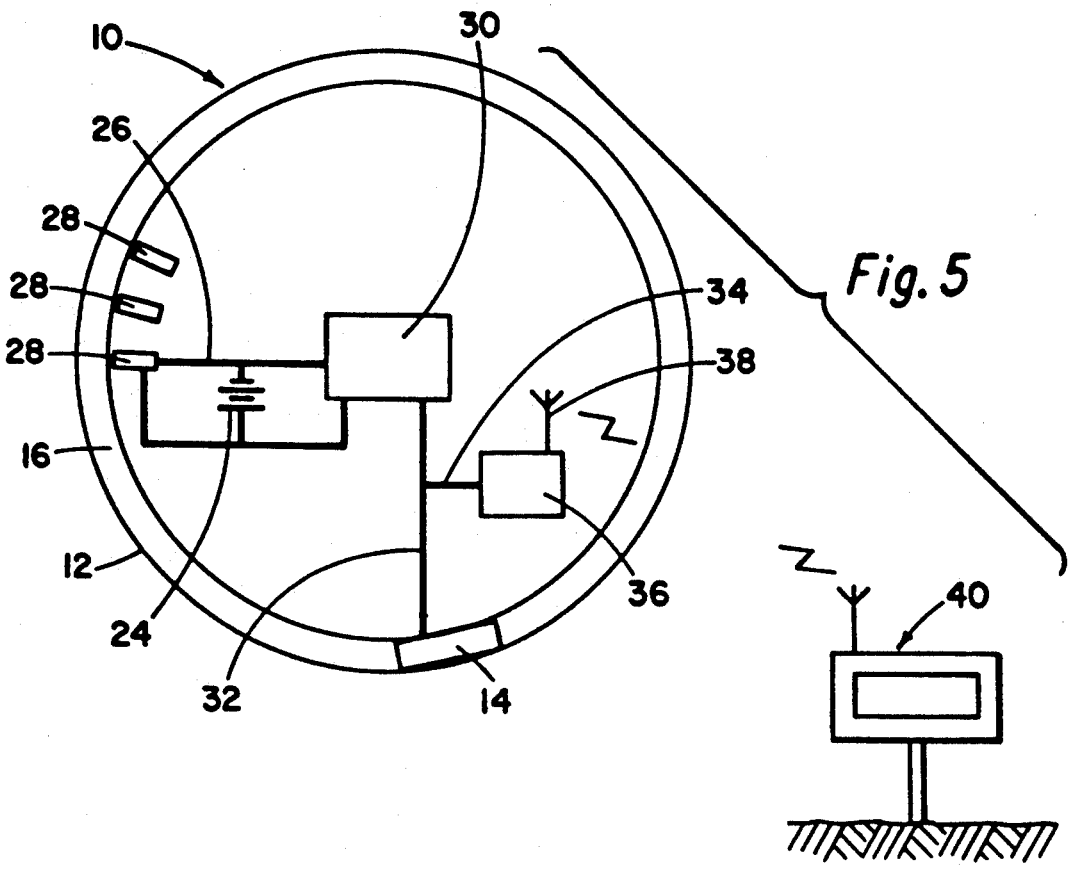
FIG. 5 is a diagrammatic view of the ball of FIG. 3 and also showing a remote receiving unit for receiving and displaying pressure data transmitted by the ball.

Referring now to FIGS. 3 and 5, the ball 10 is provided with a power source 24 connected by means of an electrical circuit 26 to a summation circuit 30 and to a multiplicity of pressure transducers 28 located adjacent the envelope 16. Although the pressure transducers 28 are described as being adjacent the envelope 16, the present invention is not so limited. In fact the pressure transducers 28 may be located adjacent the exterior surface 12 as illustrated in FIG. 4 or located in other suitable locations within the ball 10 such as illustrated in FIGS. 3 and 5 or, although not illustrated, even located on the exterior surface 12. When pressure is applied to the ball 10, as when the pitcher (not shown) grips the ball 10 to throw it, the pressure transducers 28 respond to the pressure by sending electrical impulses that are proportional to the amount of pressure exerted, from the pressure transducers 28, to the summation circuit 30. The summation circuit 30 receives the impulses from the pressure transducers and processes them to create a total pressure reading that is sent to the digital readout screen 14 for display via an electrical connection 32 that attaches on one end to the summation circuit 30 and on another end to the digital readout screen 14. Alternately or additionally, the total pressure reading may be sent from the summation circuit 30 to a transmitter 36 via an electrical connection 34 that attaches on one end to the summation circuit 30 and on another end to the transmitter 36. The transmitter 36 is provided with an antenna 38 that transmits the total pressure reading by means of radio waves or other suitable means to a remote receiving unit 40 where the total pressure reading can be displayed and recorded. The remote receiving unit 40 can be positioned so that coaches (not shown) can monitor the performance of the pitcher (not shown) as the ball 10 is thrown.

Area remaining within the ball 10, i.e. area interior to the exterior surface 12 that is not otherwise occupied, is filled with an interior mass/weight control material (not shown) that gives the ball 10 its proper heft and handle.

Additional features can be included in the ball 10, such as an audio alarm (not shown) that is automatically activated whenever the ball 10 is improperly gripped or such as means for illuminating a warning light (not shown) for warning of an improper grip. Also, instead of summing the pressures of the pressure transducer 28, individual pressures can be displayed for the pressure transducers 28 as a means of electronically mapping finger placement on the ball 10.

Whereas the present invention has been disclosed in terms of the specific structure described above, it should be understood that other and further modifications, apart from those shown or suggested herein, may be made within the spirit and scope of this invention, and the invention is limited only by the claims included herein.

What is claimed is:

1. A pressure indicating ball for training a pitcher to throw the ball, comprising:

a ball having a flexible exterior surface;

the ball being provided with a multiplicity of pressure transducers, means for processing electrical impulses being connected electrically to the pressure transducers; and the ball being provided with means for displaying pressure data, said means for displaying pressure data being electrically connected to the means for processing electrical impulses so that data received from the pressure transducers in the form of electrical impulses is displayed as pressure data by the means for displaying pressure data.

2. A pressure indicating ball according to claim 1 wherein the means for displaying pressure data comprises:

a readout screen provided on the exterior surface of the ball.

3. A pressure indicating ball according to claim 1 wherein the means for displaying pressure data comprises:

a transmitter being provided on the ball, said transmitter being provided with an antenna for transmitting pressure data to a remote receiving unit for display.

4. A pressure indicating ball according to claim 1 further comprising:

a flexible perimeter envelope adjacent to the exterior surface, pressure indicating substance being provided within the envelope, said pressure indicating substance being capable of molding to fingers of a pitcher as the pitcher grips the ball and thereby forming imprints in the ball which provide a visual indication of pressure exerted by the fingers onto the exterior surface of the ball.

5. A pressure indicating ball according to claim 4 further comprising:

a valve being located on the exterior surface and communicating with the envelope to provide a means of filling the envelope with the pressure indicating substance.

6. A pressure indicating ball according to claim 1 further comprising:

the ball being provided with material located interior to the exterior surface of the ball so that the material causes the ball to have a weight equal to a weight of a standard regulation ball.

7. A pressure indicating ball according to claim 1 wherein the means for processing electrical impulses is a summation circuit.

8. A pressure indicating ball for training a pitcher to throw the ball, comprising:

a ball having a flexible exterior surface, a flexible perimeter envelope adjacent and internal to the exterior surface so that the perimeter envelope encloses a space located between the exterior surface and a remaining interior portion of the ball, a pressure indicating substance being provided within the envelope, said pressure indicating substance being capable of molding to fingers of a pitcher as the pitcher grips the ball and thereby forming imprints in the ball which provide a visual indication of pressure exerted by the fingers onto the exterior surface of the ball;

the ball being provided with a multiplicity of pressure transducers located interior to the exterior surface, the pressure transducers being connected to a summation circuit by means of an electrical circuit; and an electrical connection between the summation circuit and a readout screen provided on the exterior surface so that data received from the pressure transducers in the form of electrical impulses is displayed as pressure data by the readout screen.

9. A pressure indicating ball according to claim 8 further comprising:

an electrical connection between the summation circuit and a transmitter provided on the ball, said transmitter provided with an antenna for transmitting pressure data to a remote receiving unit for display.

10. A pressure indicating ball according to claim 9 further comprising:

a valve being located on the exterior surface and communicating with the envelope to provide a means for filling the envelope with the pressure indicating substance.

11. A pressure indicating ball according to claim 9 further comprising:

the ball being provided with material located interior to the exterior surface of the ball so that the material causes the ball to have a weight equal to a weight of a standard regulation ball.

* * * * *